US005297308A

United States Patent [19]

Wiedeck

[11] Patent Number: 5,297,308

[45] Date of Patent: Mar. 29, 1994

[54] DEPLOYABLE BRIDGE

[75] Inventor: Hans N. Wiedeck, Mülheim an der Ruhr, Fed. Rep. of Germany

[73] Assignee: Krupp Industrietechnik Gesellschaft mit beschränkter Haftung, Duisburg, Fed. Rep. of Germany

[21] Appl. No.: 36,202

[22] Filed: Mar. 23, 1993

[30] Foreign Application Priority Data

Mar. 23, 1992 [DE] Fed. Rep. of Germany ..... 4209316

[51] Int. Cl.[5] ..... E01D 15/12

[52] U.S. Cl. ..... 14/14; 14/2.4; 14/4

[58] Field of Search ..... 14/2.4, 2.5, 2.6, 5, 14/4, 13, 14

[56] References Cited

U.S. PATENT DOCUMENTS

| | | | |
|---|---|---|---|
| 3,504,389 | 4/1970 | Longbottom | 14/13 |
| 3,597,784 | 8/1971 | Gehlen | 14/11 |
| 4,520,523 | 6/1985 | Fitzgerald-Smith et al. | 14/14 X |

FOREIGN PATENT DOCUMENTS

| | | |
|---|---|---|
| 407274 | 1/1991 | European Pat. Off. . |
| 475853 | 3/1992 | European Pat. Off. . |
| 1658619 | 10/1970 | Fed. Rep. of Germany . |
| 1945676 | 3/1971 | Fed. Rep. of Germany . |
| 2017489 | 10/1971 | Fed. Rep. of Germany . |
| 1963393 | 6/1972 | Fed. Rep. of Germany . |
| 2324646 | 12/1974 | Fed. Rep. of Germany . |
| 3321420 | 12/1983 | Fed. Rep. of Germany . |
| 1509964 | 12/1967 | France . |
| 837994 | 6/1981 | U.S.S.R. . |

*Primary Examiner*—Ramon S. Britts
*Assistant Examiner*—James A. Lisehora
*Attorney, Agent, or Firm*—Spencer, Frank & Schneider

[57] ABSTRACT

A bridge includes a bridge element which has a basic bridge body; a folding ramp situated at opposite sloped end faces of the bridge body; a hinge connection pivotally attaching each folding ramp to the bridge body; and a locking device supported by the bridge body for locking the folding ramp to the bridge body in the downfolded position of the ramp in which the ramp forms a common access ramp with the respective sloped end face of the bridge body. The locking device includes a locking pin and an actuating device for moving the locking pin into a locking position or into a withdrawn position. In the locking position the locking pin extends into a locking pin-receiving opening of the folding ramp if the folding ramp is in its downfolded position or into a locking pin-receiving opening of an adjoining basic bridge body in the upfolded position of the folding ramp. The hinge connection includes a double-jointed lever connected to the bridge body and the respective folding ramp by pivotal joints. The distance between the pivotal joints is such that pivotal motion of the folding ramp is effected with a play relative to the bridge body. Each folding ramp and the bridge body have pressure surfaces being pressed to one another by pressure forces in the upfolded position of the folding ramps.

13 Claims, 7 Drawing Sheets

DEPLOYABLE BRIDGE

CROSS REFERENCE TO RELATED APPLICATION

This application claims the priority of German Application No. P 42 09 316.3 filed Mar. 23, 1992, which is incorporated herein by reference.

BACKGROUND OF THE INVENTION

The present invention relates to a bridge composed of at least one bridge element comprising a basic bridge body having sloped end faces that terminate at mid height of the basic bridge body. The end faces are provided with a hinge connection at which a folding ramp is mounted to be pivotal in such a way that it rests on the sloped surface or—if folded down and fixed to the basic bridge body by means of a locking arrangement—it forms a common access ramp together with the sloped surface of the basic bridge body.

Such bridges are known as floating bridges (disclosed, for example, in German Offenlegungsschrift 19 63 393) as well as "fixed bridges" that are deployable on solid ground (disclosed, for example, in published European Patent Application 0,407,274 to which corresponds U.S. Pat. No. 5,033,145). Depending on the width of the obstacle to be spanned, the bridges may be composed of a single bridge element or a plurality of identical bridge elements. In a bridge composed of a single bridge element, both folding ramps are folded down and locked to the basic bridge body. In a bridge composed of two bridge elements, the folding ramps are folded down at their ends facing away from one another and are locked to the basic bridge body while at the mutually facing ends the folding ramps rest on the sloped surfaces of the basic bridge bodies. In that state they form an essentially vertical end with the basic bridge bodies. Both such ends of the bridge elements are locked at the bottom to the basic bridge bodies and, if necessary, at the top to the folding ramps in order to form a load-carrying bridge. For bridges composed of more than two bridge elements, both folding ramps of the bridge elements disposed between the outer bridge elements lie on the basic bridge body and are thus in an upfolded position. In each instance—independently of the number of bridge elements involved—the bridge elements are all identical and are universally employable as a center section, a ramp section or as an element that in itself forms a bridge.

The basic bridge bodies form a roadway on their top surface and the folding ramps form a roadway on their top and bottom surfaces. If the folding ramps are placed on the sloped surfaces of the basic bridge bodies, the basic bridge body and the folding ramp together form a continuous roadway. The basic bridge body and the folding ramps may extend over the entire width of the roadway, or they may constitute only the width of one track (lane) and may be connected in a known manner by means of transverse supports.

While the German patent document 19 63 393 discloses no structural details, in the bridge elements disclosed in European Patent Application 0,407,274 the locking arrangement is composed of a hook coupling which, however, is able to transmit only tensile forces. For transmitting transverse forces, additional convex and corresponding concave shaped elements are provided which, however, represent additional weight thus reducing the load carrying capability of the bridge. It is another disadvantage of this prior art construction that if the bridge has been soiled by use, the hook couplings may not operate reliably and thus increased expenditures are involved in verifying the operational reliability of the bridge to be deployed.

In a bridge center section in which the folding ramps rest on the basic bridge body, as in the bridge disclosed in the earlier-noted European patent application, the pressure forces acting on the folding ramp in the longitudinal direction of the bridge are transmitted to the basic bridge body essentially by way of a hinge connection. In the downfolded state for forming a ramp section or an individual bridge, the hinge joint lies at the height of the roadway so that it is subjected to wear from heavy vehicles, particularly track-laying vehicles, that drive over it.

SUMMARY OF THE INVENTION

It is an object of the invention to provide an improved bridge of the above-mentioned type from which the stated drawbacks are eliminated and the reliability of operation of the bridge is increased.

This object and others to become apparent as the specification progresses, are accomplished by the invention, according to which, briefly stated, the bridge includes a bridge element which has a basic bridge body; a folding ramp situated at opposite sloped end faces of the bridge body; a hinge connection pivotally attaching each folding ramp to the bridge body; and a locking device supported by the bridge body for locking the folding ramp to the bridge body in the downfolded position of the ramp in which the ramp forms a common access ramp with the respective sloped end face of the bridge body. The locking device includes a locking pin and an actuating device for moving the locking pin into a locking position or into a withdrawn position. In the locking position the locking pin extends into a locking pin-receiving opening of the folding ramp if the folding ramp is in its downfolded position or into a locking pin-receiving opening of an adjoining basic bridge body in the upfolded position of the folding ramp. The hinge connection includes a double-jointed lever connected to the bridge body and the respective folding ramp by pivotal joints. The distance between the pivotal joints is such that pivotal motion of the folding ramp is effected with a play relative to the bridge body. Each folding ramp and the bridge body have pressure surfaces being pressed to one another by pressure forces in the upfolded position of the folding ramps.

The use of a pin coupling makes a positive and reliable interconnection of the bridge components feasible. The pins not only absorb forces occurring in the longitudinal direction of the bridge, they also are capable of transmitting vertical transverse forces. The double jointed levers allow—within certain limits—free movement of the folding ramp relative to the basic bridge body and thus make it possible that the folding ramp is positively supported against the basic bridge body by the common pair of pressure surfaces if pressure forces are generated in the longitudinal direction of the bridge. The hinge connection formed by the double-jointed levers is maintained free of forces. In addition, a lateral arrangement of the double-jointed levers avoids wear on the hinge connection as vehicles travel over the bridge.

As an advantageous feature of the invention, the basic bodies of a bridge composed of at least two bridge elements are provided with a bottom boom tensioning assembly having its own bottom boom that is connected with the basic body. The bottom boom of each basic body can be connected with the bottom boom of the respective adjacent basic body by means of a locking arrangement. In a preferred embodiment, the locking arrangement for the bottom booms comprises a pin coupling provided on one of the bottom booms. The pins engage in recesses of the respectively adjacent bottom boom. Thus, in such a bridge, the bottom boom of the bottom tensioning assembly can be simultaneously coupled to and uncoupled from the basic bodies.

Each pin coupling preferably includes two pins that are movable on a common axis and engage in a recess of another basic bridge body or folding ramp. The pins preferably move simultaneously in opposite directions so that a statically unequivocal, symmetrical force distribution results for the coupling.

The pin-receiving openings are preferably passages provided in fixed brackets. The pins may be supported on both sides of the brackets to ensure favorable load conditions therefor.

The motion of the pins is effected by a sliding guide which has symmetrical control grooves for the two pins. A cam disc is provided for the movement of the sliding guide. The cam disc has a cam track shaped as the involute of a circle, resulting in a movement of the sliding guide such that the sliding guide is essentially not exposed to transverse forces.

It is particularly advantageous to fasten the cam disc to a transverse shaft that extends over the entire width of the bridge element or the track carrier. Such an arrangement permits the actuation of the pin couplings simultaneously by the transverse shaft in one coupling plane.

In order to prevent an inadvertent lifting of the folding ramps, the region of their flat ends is provided with a projection which—in the upfolded state in which the folding ramps lie on the carrier member and are charged with pressure forces in the longitudinal direction of the bridge, pushing them against the basic bridge body—engages in a recess in the basic bridge body that is provided with a stop toward the roadway. The engagement of the projection in the recess occurs automatically in the presence of pressure and no additional safety measures are required.

DESCRIPTION OF THE PREFERRED EMBODIMENTS

Figure 1:
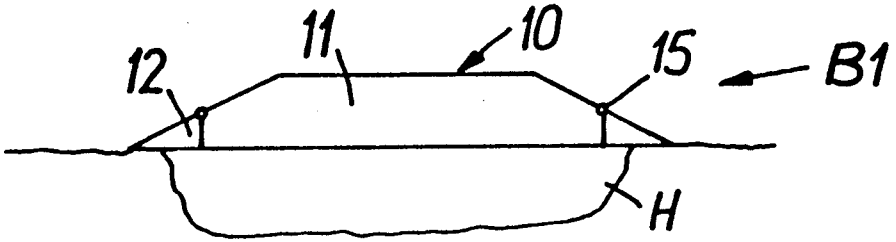
FIG. 1 is a side elevational view of a bridge composed of a bridge element including a basic bridge body and two folding ramps.
Figure 2:
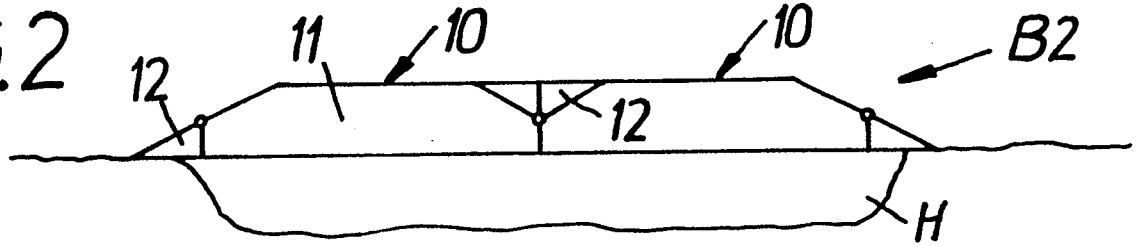
FIG. 2 is a side elevational view of a bridge composed of two bridge elements.
Figure 3:
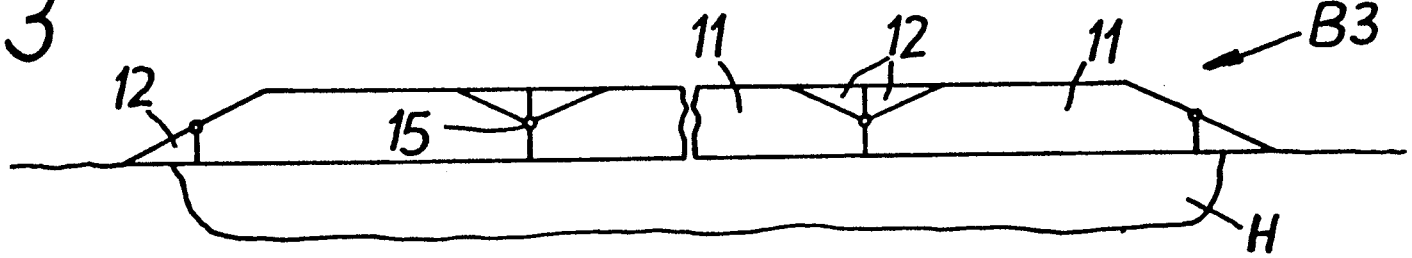
FIG. 3 is a side elevational view of a bridge composed of at least three bridge elements.

Turning to FIGS. 1, 2 and 3, depending on the width or breadth of an obstacle H, for example, a crevice in the terrain or a river bed, the bridge provided to cross the obstacle may be composed of a single bridge element 10 (bridge B1, FIG. 1) two bridge elements (bridge B2, FIG. 2) or three or more bridge elements (bridge B3, FIG. 3). All bridge elements 10 have the same configuration and are essentially composed of a basic bridge body or carrier member 11 and two folding ramps 12.

Figure 4:
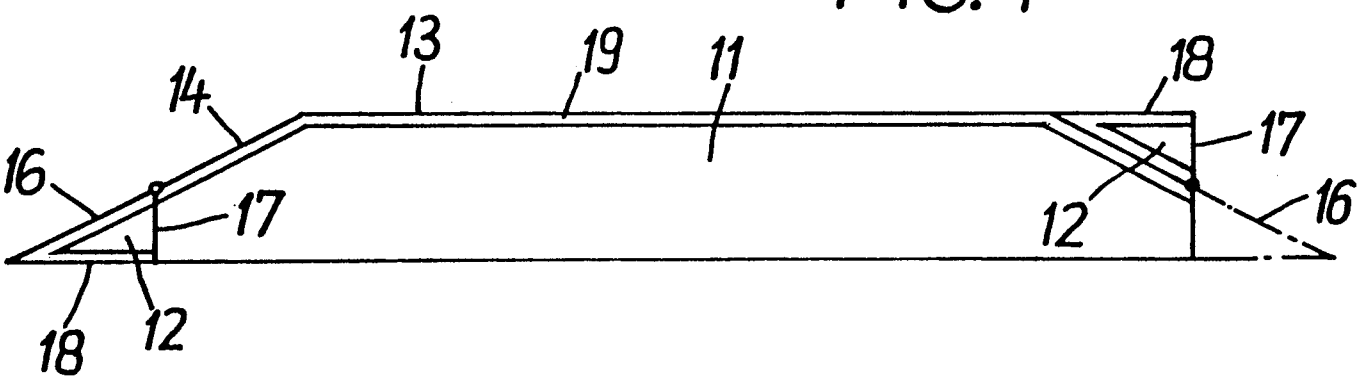
FIG. 4 is a side elevational view of a bridge element having a sloped end and a flat end.

Also referring to FIG. 4, on its top side, the basic bridge body 11 has a central horizontal surface 13 and a sloped surface 14 at each end. A hinge connection 15 to which the folding ramps 12 are articulated is provided at the ends of the sloped surfaces 14. The folding ramps 12— seen from the side—have the shape of a right-angled triangle. The length of the long side (hypotenuse) or surface 16 corresponds to the length of sloped surface 14, the small side or surface 17 has one-half the height of the basic bridge body 11 and the middle side or surface 18 (large side of the triangle) corresponds to the projection of the sloped surface 14.

Surfaces 13, 14, 16, and 18 are provided with a suitable roadway 19. In bridge B1, the roadway sections 19 of ramp surfaces 16 and 14 and horizontal surface 13 form the roadway, in a bridge element of bridge B2, the roadway at the end facing the adjacent bridge element is formed by the horizontal surface 13 and surface 18.

Figure 6:
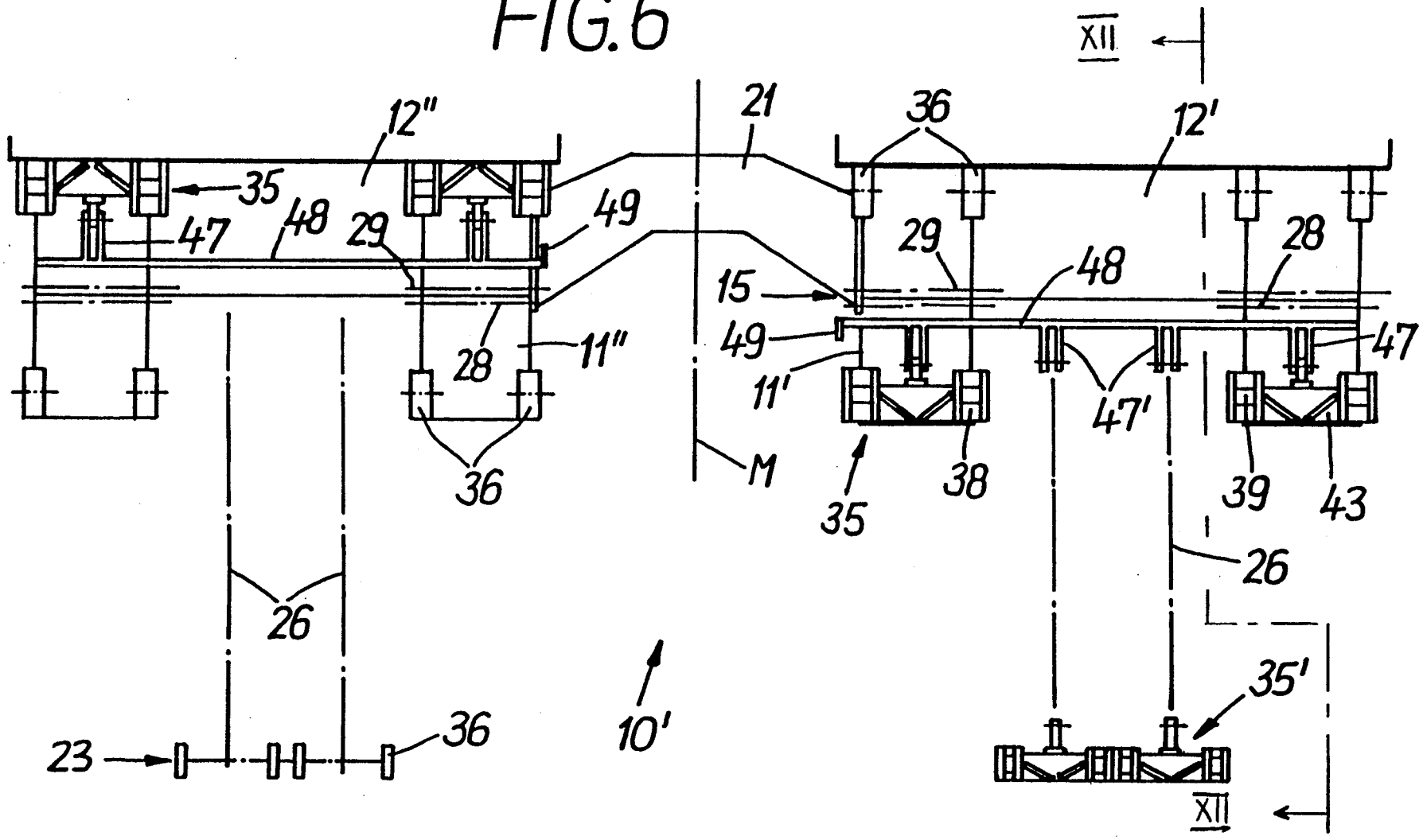
FIG. 6 is a partial sectional view taken along line VI—VI of FIG. 5 of a bridge formed of track carriers, wherein coupling members of the bridge element lying in front of the section line are omitted.

Basic bridge body 11 as well as folding ramps 12 may extend over the entire width of the roadway or, as illustrated in FIG. 6, they may be formed of two track elements 11', 11'' and 12', 12'', respectively, wherein the basic bridge bodies 12' and 12'' are connected by means of transverse carriers 21.

Figure 5:
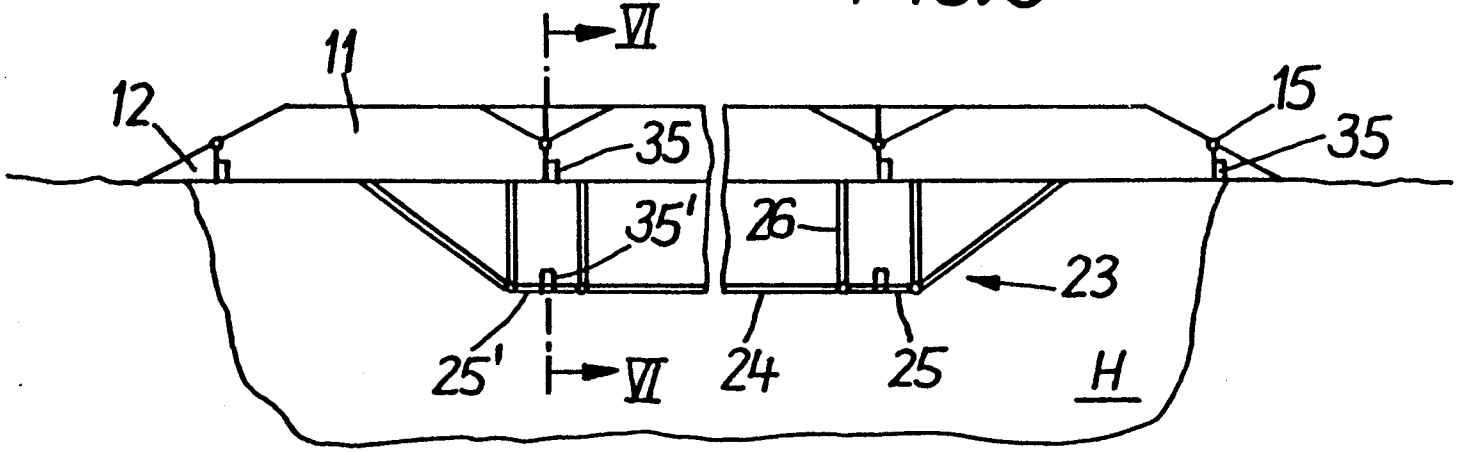
FIG. 5 is a side elevational view of a bridge including a bottom tensioning assembly.

In order to span large obstacles, basic bridge bodies 11, 11', and 11'', respectively, may be provided with a bottom tensioning assembly 23 as shown in FIG. 5. Such a structure is disclosed in greater detail in German Offenlegungsschrift 40 38 763. Bottom tensioning assembly 23 is composed of bottom boom sections 24 and 25, 25' which can be lowered or raised by means of movable pillars 26.

The description which follows is based on a bridge element 10' that is provided with track elements 11', 11'' and 12', 12''.

Figure 7:
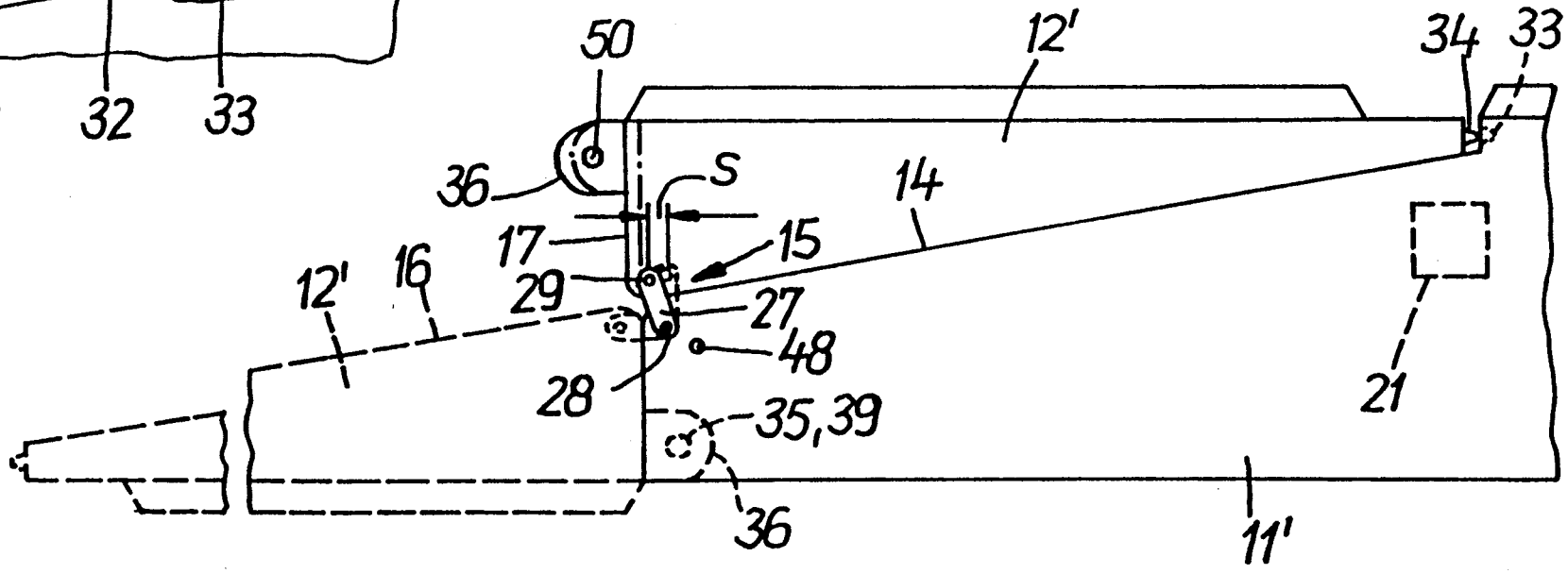
FIG. 7 is a side elevational view of that end of a basic bridge body on which a folding ramp lies.

Turning to FIG. 7, the folding ramp track elements 12', 12'' are connected by a double-jointed lever 27 with the basic bridge body 11 (formed of track elements 11', 11'' and transverse supports 21). Each double-jointed lever 27 is articulated to the basic bridge body 11 at a horizontal pivot axis 28 and to the folding ramp 12 at a horizontal pivot axis 29. The axis 28 lies essentially at the end of sloped surface 14, whereas the axis 29 is situated in the corner region formed by surfaces 16 and 17. Both corner regions are rounded in order to allow for unimpeded "folding" or laying down of folding ramps 12. The double-jointed levers 27 have such a length that the surface 16 of folding ramp 12 is able to perform a certain displacement s on sloped surface 14. One of the bores of the double-jointed levers 27 may be slot shaped to allow a displacement with play.

Figure 8:
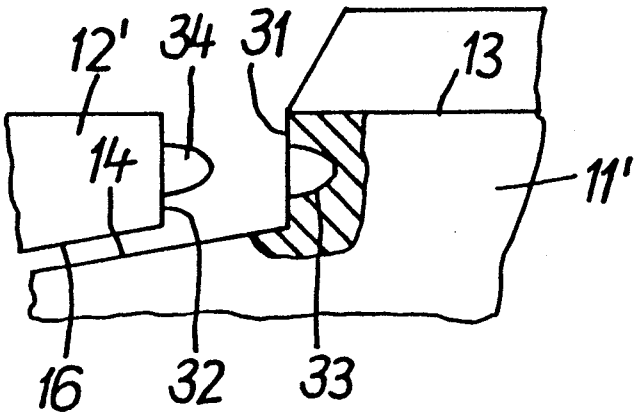
FIG. 8 is a side elevational view, partially in section, showing the pair of pressure surfaces of a folding ramp and a basic bridge body.

Also referring to FIG. 8, a vertical pressure surface 31 is disposed in the transition region between the sloped surface 14 and the horizontal surface 13 of basic bridge body 11. The pressure surface 31 serves as contact with a corresponding pressure surface 32 at the flat end of folding ramp 12. Recesses 33 for the engagement of projections or transverse force lugs 34 provided on pressure surface 32 are provided in pressure surface 31.

FIG. 7 shows one end of a bridge element 10 or 10', depicted as the folding process from the downfolded position shown in dashed lines into the upfolded position has just been completed. During the assembly of the adjacent bridge elements to be coupled, folding ramp 12' is subjected to a force in the direction toward pressure surface 31 and is pressed to the right over a path s until both pressure surfaces 31 and 32 lie against one another and transverse force lug 34 projects into recess 33 (this state is shown in the left outline of the folding ramp in dot-dash lines in FIG. 7).

Of the track elements visible in FIG. 7, track element 11' has two pin couplings 35 for engagement with two brackets 36 at folding ramp 12' in the folded-down state thereof, as shown in dashed line in FIG. 7. As shown in FIG. 6, at the oppositely disposed track elements—with respect to the vertical center plane M of the bridge element—the pin couplings 35 are attached to the track element 12'' of the folding ramp and the brackets 36 are attached to the track element 11' of the basic bridge body. At the other end of the track element 11'—seen in the longitudinal directibn of the bridge—there are provided brackets 36 and at the other end of the track element 11'' there are provided pin couplings 35. The front view of the other ends of the track elements 11' and 11'' with the ramps 12' and 12'' in the upfolded position is the same as depicted in FIG. 6.

Figure 10:
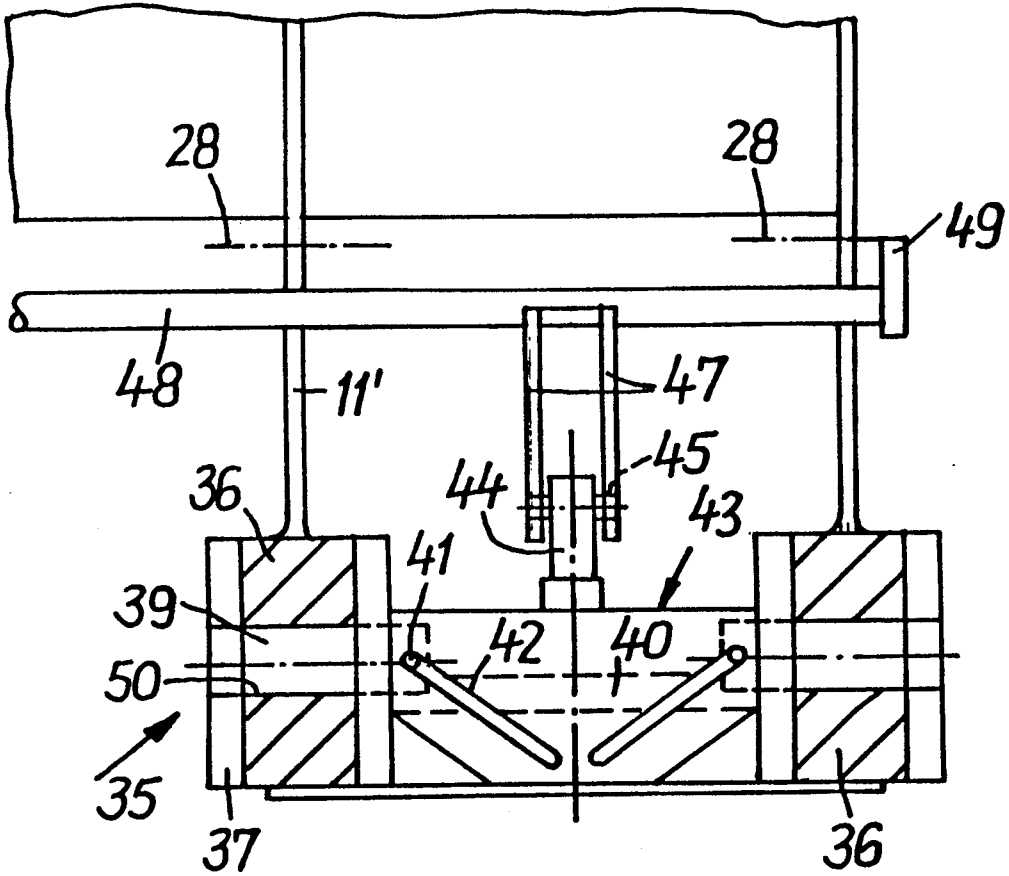
FIG. 10 is a front elevational view of the pin coupling shown in FIG. 9.
Figure 9:
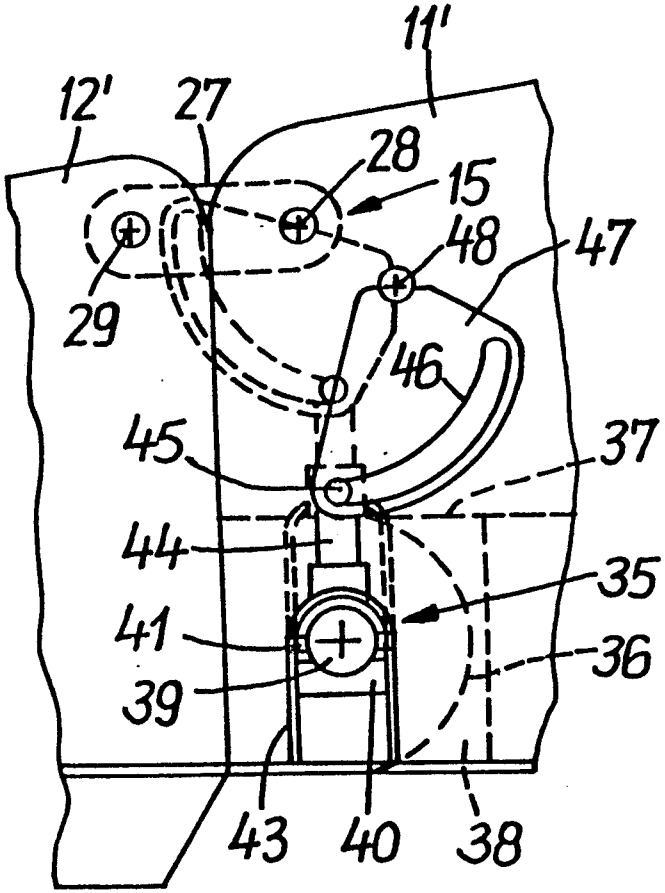
FIG. 9 is a partially exposed side elevational view of a pin coupling of a basic bridge body.
Figure 11:
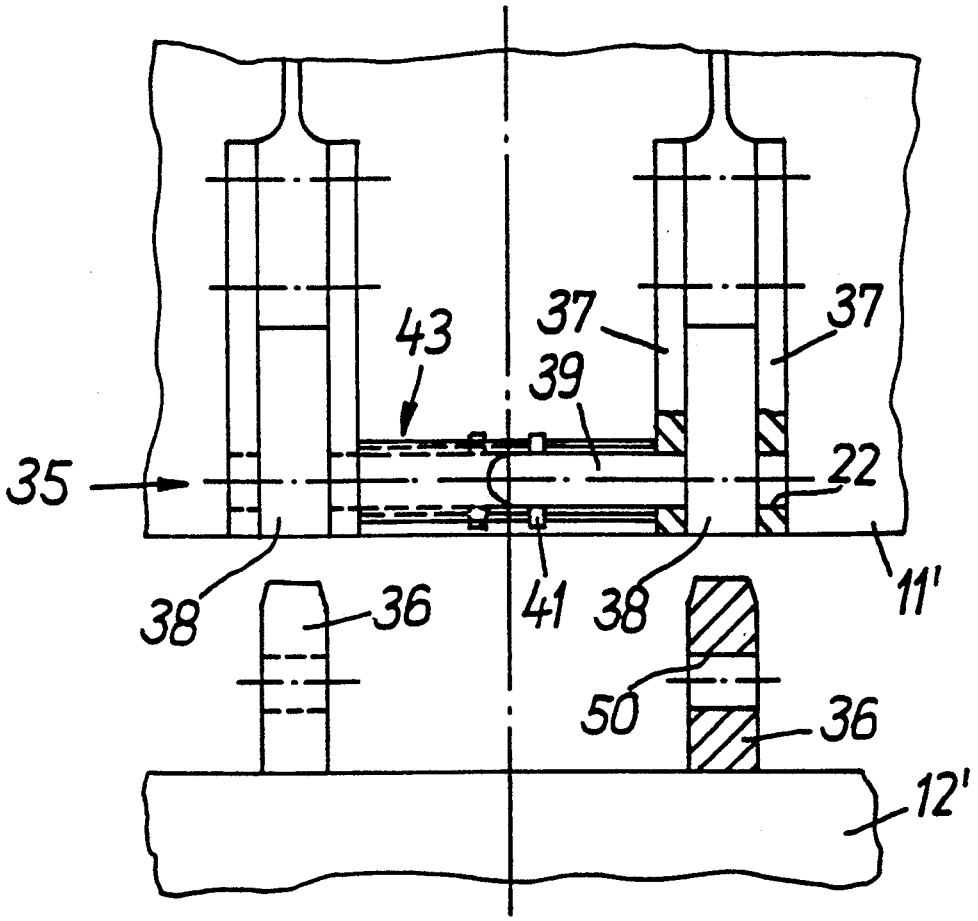
FIG. 11 is a top plan view of the pin coupling shown in FIG. 9, depicted just prior to coupling the bridge sections together.

Turning to FIGS. 9 and 10, the pin couplings 35 are accommodated within track element 11'. Each pin coupling includes two receptacles 38 intended for the accommodation of the brackets 36 of a folding ramp 12 or of another basic bridge body 11 and formed of cheeks 37 and two pins 39. A guide 40 for pins 39 is provided between the respective inner cheeks 37, and the pins 39 are guided in passage holes 22 in cheeks 37. On each side, pins 39 are provided with stubs 41 which engage in control or cam grooves 42 of a sliding guide 43 that surrounds the pins on both sides. At its upper end, sliding guide 43 is provided with a holder 44 which has two lateral stubs 45 that each engage in a control or cam groove 46 of a pair of control or cam discs 47. The control discs of all coaxial pin couplings 35 of a track element 11', 11'', 12', 12'', respectively, are fastened to a common coupling shaft 48 which can be actuated by a coupling lever 49, for example from a bridge laying vehicle (not shown).

Before the joining of two bridge components—either a folding ramp 12 with a basic bridge body 11 to form a ramp section or two bridge elements with an upfolded folding ramp 12 lying on the basic bridge body 11—the control discs 47 are in the upper position shown in dashed lines in FIG. 9 in which the sliding guide 43 is pulled upward and the pins 39 are retracted so that they release the receptacles 38 for brackets 36.

After joining the bridge elements, brackets 36 are seated in the receptacles 38 of the respective pin coupling 35. Thereupon, the lever 49 is actuated and the coupling shaft 48 is rotated and control discs 47 are brought into the lower position shown in solid lines in FIG. 9. This causes the guide 43 to be pressed downward and pins 39 to be pushed into the holes 50 of brackets 36 and the holes 22 of outer cheeks 37.

Figure 12:
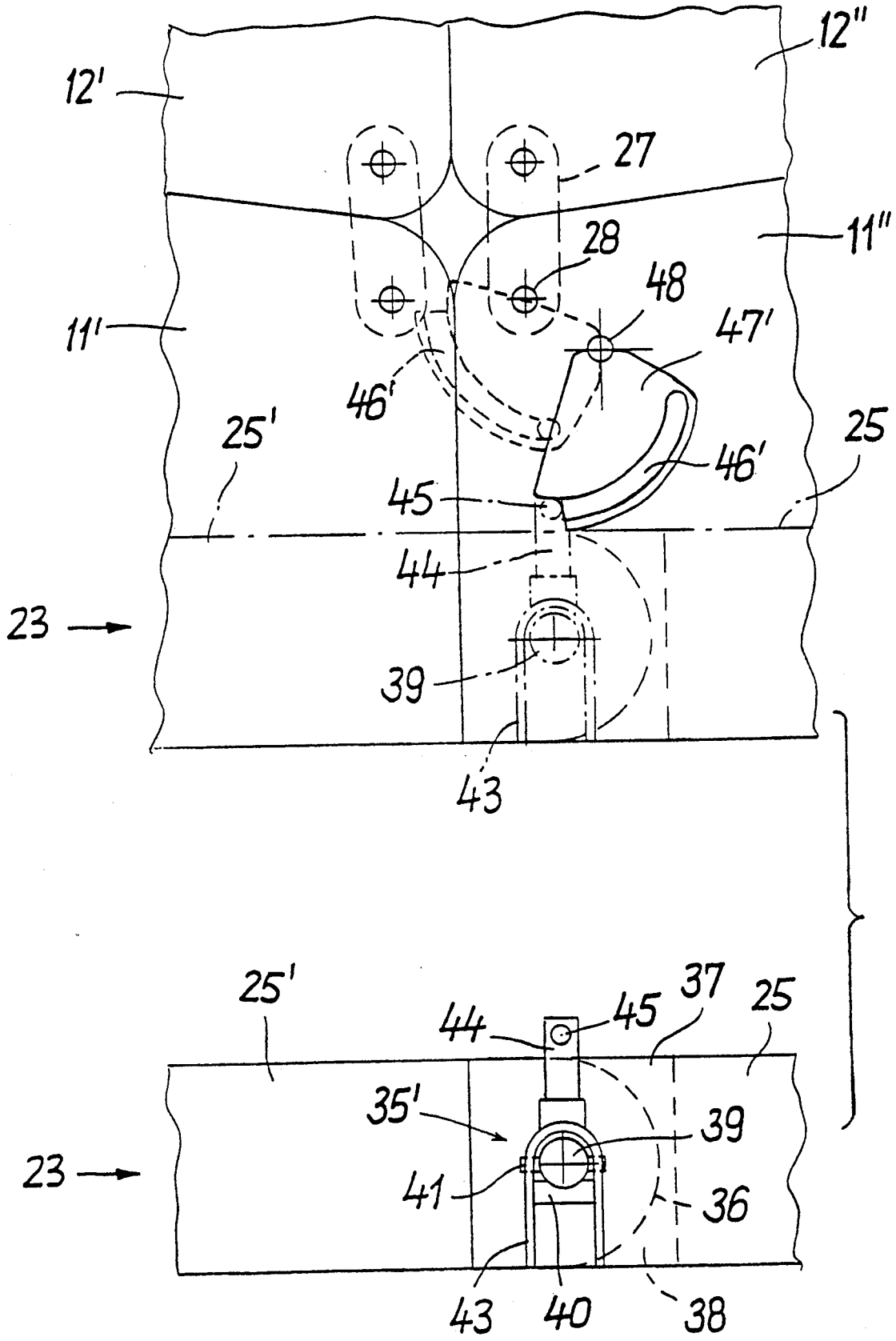
FIG. 12 is a fragmentary sectional view, taken along line XII—XII of FIG. 6, of two bridge elements with their respective tensioning assembly in a coupled state.

As shown in FIGS. 5 and 12, at one bottom boom section 25, the bottom tensioning assembly 23 is provided with a pin coupling 35' and with corresponding brackets 36 at the opposite bottom boom section 25'. The configuration of all pin couplings 35, 35' is identical except for the fact that the cam grooves 46' of control discs 47' of pin couplings 35' of bottom tensioning assembly 23 are open at the location involved with the coupled state. If a bridge having a bottom tensioning assembly is to be deployed, all couplings 35, 35' are coupled when the bottom tensioning assembly 23 is still being raised into its position shown in dash-dot lines in FIG. 12. At the end of the coupling process, the open portion of the control cam of control disc 47' is exposed so that bottom tensioning assembly 23 can be lowered as desired, into the position shown in solid lines in FIG. 12. To separate the bridge elements, the bottom tensioning assembly must first again be retracted. In that state, pins 45 of holder 44 of pin coupling 35' are actuated by control discs 47' when coupling shaft 48 is actuated. The control discs 47' are fastened to the same coupling shaft as the control discs 47.

It will be understood that the above description of the present invention is susceptible to various modifications, changes and adaptations, and the same are intended to be comprehended within the meaning and range of equivalents of the appended claims.

What is claimed is:

1. In a bridge including a bridge element having a basic bridge body having a height and including opposite sloped end faces and a horizontal top face; the end faces extending from opposite ends of said top face and terminating at mid height of said basic bridge body;

a folding ramp situated at each sloped end face; each folding ramp having a travel face;

a hinge connection pivotally attaching each folding ramp to a respective said sloped end face to provide movement of each said folding ramp into upfolded and downfolded positions; in the upfolded position the travel face of the folding ramp is in a face-to-face engagement with the respective sloped end face of the basic bridge body and in the downfolded position the travel face of the folding ramp forms a common access ramp with the respective sloped end face of the basic bridge body; and a locking device supported by said basic bridge body for firmly locking the folding ramp to the basic bridge body in the downfolded position;

the improvement wherein said folding ramps and opposite ends of said basic bridge body include means for defining locking pin-receiving openings;

said locking device includes a locking pin and actuating means for moving the locking pin into a locking position or into a withdrawn position; in said locking position the locking pin extends into the locking pin-receiving opening of said folding ramp if the folding ramp is in said downfolded position or into the locking pin-receiving opening of an adjoining basic bridge body in said upfolded position of said folding ramp and in said withdrawn position the locking pin is retracted from said locking pin-receiving openings;

said hinge connection comprises a double-jointed lever connected to the basic bridge body by a first pivotal joint and to the respective folding ramp by a second pivotal joint; a distance between said first and second pivotal joints being such that pivotal motion of the folding ramp is effected with a play relative to said basic bridge body; and each said folding ramp and said basic bridge body have pressure surfaces being pressed to one another by pressure forces in said upfolded position of said folding ramps.

2. The bridge as defined in claim 1, wherein said means defining said locking pin-receiving opening comprises a fixed bracket and said opening is constituted by a passage in said bracket.

3. The bridge as defined in claim 1, wherein said actuating means comprises a movable sliding guide including a cam track; said locking pin having a part extending into said cam track; said locking pin being displaced upon motion of said sliding guide.

4. The bridge as defined in claim 1, further comprising a projection provided in said pressure face of said folding ramp and a recess provided in said pressure face of said basic bridge body; in said upfolded position of said folding ramp and in a presence of pressure forces oriented in a length direction of said basic bridge body said recess receiving said projection; said recess being closed in a direction toward said horizontal top face for preventing said projection from moving out of said recess in an upward direction.

5. The bridge as defined in claim 1, wherein said bridge element is a first bridge element; further comprising a second bridge element being structured identically to said first bridge element and adjoining said first bridge element; each bridge element having a bottom tensioning assembly including a height-adjustable bottom boom coupled to a respective said bridge element; and further comprising an additional locking device connecting the bottom booms of said first and second bridge elements.

6. The bridge as defined in claim 5, wherein said bottom booms include means for defining locking pin-receiving openings; said additional locking device includes a locking pin and actuating means for moving the locking pin into a locking position or into a withdrawn position; in said locking position the locking pin extends into the locking pin-receiving opening of a respective said bottom boom and in said withdrawn position the locking pin is retracted from said locking pin-receiving opening of the respective bottom boom.

7. The bridge as defined in claim 6, wherein said locking device has two locking pins movable along a common axis and said actuating means includes means for moving the two locking pins simultaneously in opposite directions.

8. The bridge as defined in claim 1, wherein said locking device has two locking pins movable along a common axis and said actuating means includes means for moving the two locking pins simultaneously in opposite directions.

9. The bridge as defined in claim 8, wherein said actuating means comprises a movable sliding guide including separate cam tracks; said locking pins having a part extending into a respective said cam track; said locking pins being displaced along said common axis upon motion of said sliding guide.

10. The bridge as defined in claim 9, wherein said cam tracks for said two locking pins are symmetrically disposed.

11. The bridge as defined in claim 10, wherein said actuating means further comprises a rotatable control disc and a coupler connecting said control disc with said movable sliding guide.

12. The bridge as defined in claim 11, wherein said control disc includes a cam track shaped as an involute of a circle; said coupler having a part extending into said cam track of said control disc.

13. The bridge as defined in claim 12, wherein said actuating means further comprises a transverse shaft extending along an entire width of said basic bridge body; said control disc being affixed to said transverse shaft.

* * * * *